US008225715B2

(12) United States Patent
Schmidt

(10) Patent No.: US 8,225,715 B2
(45) Date of Patent: Jul. 24, 2012

(54) TRANSFER DRUM BETWEEN PRINTING UNITS OF A SHEET-FED PRINTING PRESS

(75) Inventor: Thomas Schmidt, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 881 days.

(21) Appl. No.: 12/116,474

(22) Filed: May 7, 2008

(65) Prior Publication Data

US 2008/0276815 A1 Nov. 13, 2008

(30) Foreign Application Priority Data

May 11, 2007 (DE) ..... 10 2007 022 131

(51) Int. Cl.
*B41F 21/00* (2006.01)

(52) U.S. Cl. ..... 101/409; 101/246

(58) Field of Classification Search ..... 101/246, 101/408–412
See application file for complete search history.

(56) References Cited

U.S. PATENT DOCUMENTS

| | | | | | |
|---|---|---|---|---|---|
| 3,654,861 | A * | 4/1972 | Rudolph et al. | ..... | 101/183 |
| 3,865,362 | A * | 2/1975 | Luffy et al. | ..... | 271/82 |
| 3,926,118 | A * | 12/1975 | Preuss | ..... | 101/246 |
| 3,937,142 | A * | 2/1976 | Cerny et al. | ..... | 101/409 |
| 4,018,161 | A * | 4/1977 | Johne et al. | ..... | 101/231 |
| 4,241,658 | A * | 12/1980 | Ricciardi | ..... | 101/217 |
| 4,357,870 | A * | 11/1982 | Rudolph et al. | ..... | 101/246 |
| 4,448,125 | A * | 5/1984 | Kawaguchi et al. | ..... | 101/185 |
| 4,864,929 | A * | 9/1989 | Simeth | ..... | 101/246 |
| 5,172,634 | A * | 12/1992 | Iwamoto | ..... | 101/410 |
| 5,701,819 | A | 12/1997 | Stephan | | |
| 5,732,628 | A * | 3/1998 | Kemmerer et al. | ..... | 101/409 |
| 6,715,751 | B2 * | 4/2004 | Henn | ..... | 271/82 |
| 2002/0092432 | A1 * | 7/2002 | Stephan | ..... | 101/230 |

FOREIGN PATENT DOCUMENTS

| | | | |
|---|---|---|---|
| CN | 1128705 | A | 8/1996 |
| DE | 41 18 584 | A1 | 12/1992 |
| DE | 196 17 492 | A1 | 11/1997 |
| DE | 103 14 545 | B4 | 10/2003 |

OTHER PUBLICATIONS

German Patent and Trademark Office Search Report, dated Nov. 6, 2007.

* cited by examiner

*Primary Examiner* — Ren Yan
*Assistant Examiner* — David Banh
(74) *Attorney, Agent, or Firm* — Laurence A. Greenberg; Werner H. Stemer; Ralph E. Locher

(57) ABSTRACT

A transfer drum between printing units in a sheet-fed printing press includes gripper systems which can be switched to a desired mode of operation by simple measures and ensure stable and reliable transport of a sheet between printing units when in a respective operating position. A drum body has journals for supporting the drum body in side walls and two gripper systems provided on the drum body. The gripper systems are radially extendable into an operating position depending on a selected mode of operation for printing on only one side or for printing on both sides of the sheet. The gripper systems are disposed diametrically opposite each other relative to an axis of rotation of the drum body and are attached to a support disposed in the drum body to move in radial direction.

3 Claims, 6 Drawing Sheets

TRANSFER DRUM BETWEEN PRINTING UNITS OF A SHEET-FED PRINTING PRESS

CROSS-REFERENCE TO RELATED APPLICATION

This application claims the priority, under 35 U.S.C. §119, of German Patent Application DE 10 2007 022 131.4, filed May 11, 2007; the prior application is herewith incorporated by reference in its entirety.

BACKGROUND OF THE INVENTION

Field of the Invention

The invention relates to a transfer drum between printing units of a sheet-fed printing press. The transfer drum includes a drum body having journals for supporting the drum body for rotation in side walls. Two gripper systems are provided on the drum body so as to be extendable in radial direction into an operating position, depending on a selection of a mode of operation for printing on only one side of a sheet or of a mode of operation for printing on both sides of a sheet.

German Published, Non-Prosecuted Patent Application DE 41 18 584 A1 discloses a transfer drum of a sheet-fed printing press. The transfer drum includes two gripper systems of different types, which may be activated depending on whether the press is in the straight-printing mode or in the perfecting mode, i.e. whether one or both sides of the sheets are to be printed. In order to set a desired mode of operation, gear mechanisms including a plurality of gearing elements, for example gearwheels, levers, joints, stops, and a clutch, are provided. The main element of the gear mechanism is an adjustment disk that can be adjusted into two rotary positions about the axis of rotation of the transfer drum. The gripper systems are coupled to the rotation of the adjustment disk. In the respective stop position, the grippers of the gripper system assume a specific radial position and cooperate with or are uncoupled from control cams.

BRIEF SUMMARY OF THE INVENTION

It is accordingly an object of the invention to provide a transfer drum between printing units of a sheet-fed printing press, which overcomes the hereinafore-mentioned disadvantages of the heretofore-known devices of this general type and which has gripper systems that are adjustable to a desired mode of operation by simple measures and ensure stable and reliable conveying of sheets between printing units when in an operating position.

With the foregoing and other objects in view there is provided, in accordance with the invention, a transfer drum to be disposed between printing units of a sheet-fed printing press. The transfer drum comprises a drum body having an axis of rotation and journals for supporting the drum body for rotation in side walls. Two gripper systems are disposed on the drum body for extension in radial direction into an operating position, depending on a selection of a mode of operation for printing on only one side of a sheet or of a mode of operation for printing on both sides of a sheet. A support is disposed in the drum body for radial adjustment to support the gripper systems diametrically relative to the axis of rotation of the drum body.

In accordance with the invention, two gripper systems of different construction are disposed on a support in such a way as to be diametrically opposite each other with respect to the axis of rotation of a transfer drum. The support is movable in the radial direction between two operating positions.

A transfer drum for reversing a sheet between two printing units may include a gripper system that is constructed as what is referred to as a straight-printing gripper system, including gripper fingers and gripper pads that are stationary with respect to the support, and another gripper system constructed as what is referred to as a perfecting gripper system, including pivotable pliers-type grippers. A displacement of the support causes one of the gripper systems to be moved into an operating position in which a transfer of a sheet from a revolving element upstream of the transfer drum or to a downstream revolving element is possible. The gripper system that is not being used in the specific case is located radially below the revolving contour of the gripper system that is in the operating position. When it is moved into the operating position, a gripper system is coupled to a gear mechanism for controlling the grippers. If the controlling gear mechanism is a cam mechanism, in the operating position, a cam follower is brought into engagement with a control cam.

In a sheet-fed printing press that includes a transfer drum, a storage drum, and a reversing drum for reversing a sheet between two impression cylinders, the gripper systems are disposed diametrically opposite each other on the reversing drum. Depending on the mode of operation, i.e. printing on only one side of the sheet or printing on both sides of the sheet, the phases of the reversing drum, the upstream storage drum, and the downstream impression cylinder must be matched. In order to adjust the phases, two gearwheels may be provided on a journal of the reversing drum, with one gearwheel meshing with driving gear of the storage drum and the other meshing with driving gear of the impression cylinder. The gearwheels are separately couplable to the journal of the reversing drum.

In order to adjust the phase, the reversing drum is locked in its angular position, for example through the use of a locking lever. Then, the coupling of the gearwheel that meshes with the gearwheel of the impression cylinder is released. Then, the angular position of the impression cylinder is adjusted relative to the angular position of the reversing drum in such a way that the desired gripper system of the reversing drum cooperates with a gripper system of the impression cylinder. Afterwards, the gearwheel that meshes with the driving gear of the impression cylinder is firmly recoupled to the journal of the reversing drum. Subsequently, the second coupling between the gearwheel meshing with the driving gear of the storage drum and the journal is released. Then, the angular position of the storage drum relative to the angular position of the reversing drum is adjusted in such a way that the desired gripper system of the reversing drum cooperates with a gripper system of the storage drum. Finally, the second clutch is activated to fix the gearwheel meshing with the driving gear of the storage drum against rotation relative to the journal. Both phase adjustments may take place simultaneously. If the pliers-type gripper system has been moved into the operating position for printing on both sides and needs to be adapted to a new sheet length, only the clutch of the gearwheel that meshes with the driving gear of the storage drum is released, and the angular position of the storage drum is adjusted to the new sheet length. Hydraulically operated clutches that can be switched separately can be used to couple the gearwheel to the journal of the reversing drum and to uncouple it therefrom. Alternatively, the clutches may be operated jointly. In this case, the impression cylinder needs to be locked for an adjustment to the sheet length to be carried out.

The gripper system that is not being used can be covered by a guard that may simultaneously act as a sheet-guiding element during conveying of a sheet. The sheet-guiding element may additionally be equipped with blowers and/or suction devices.

In the respective operating position, the support rests against stops and is locked against radial displacement.

Other features which are considered as characteristic for the invention are set forth in the appended claims.

Although the invention is illustrated and described herein as embodied in a transfer drum between printing units of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
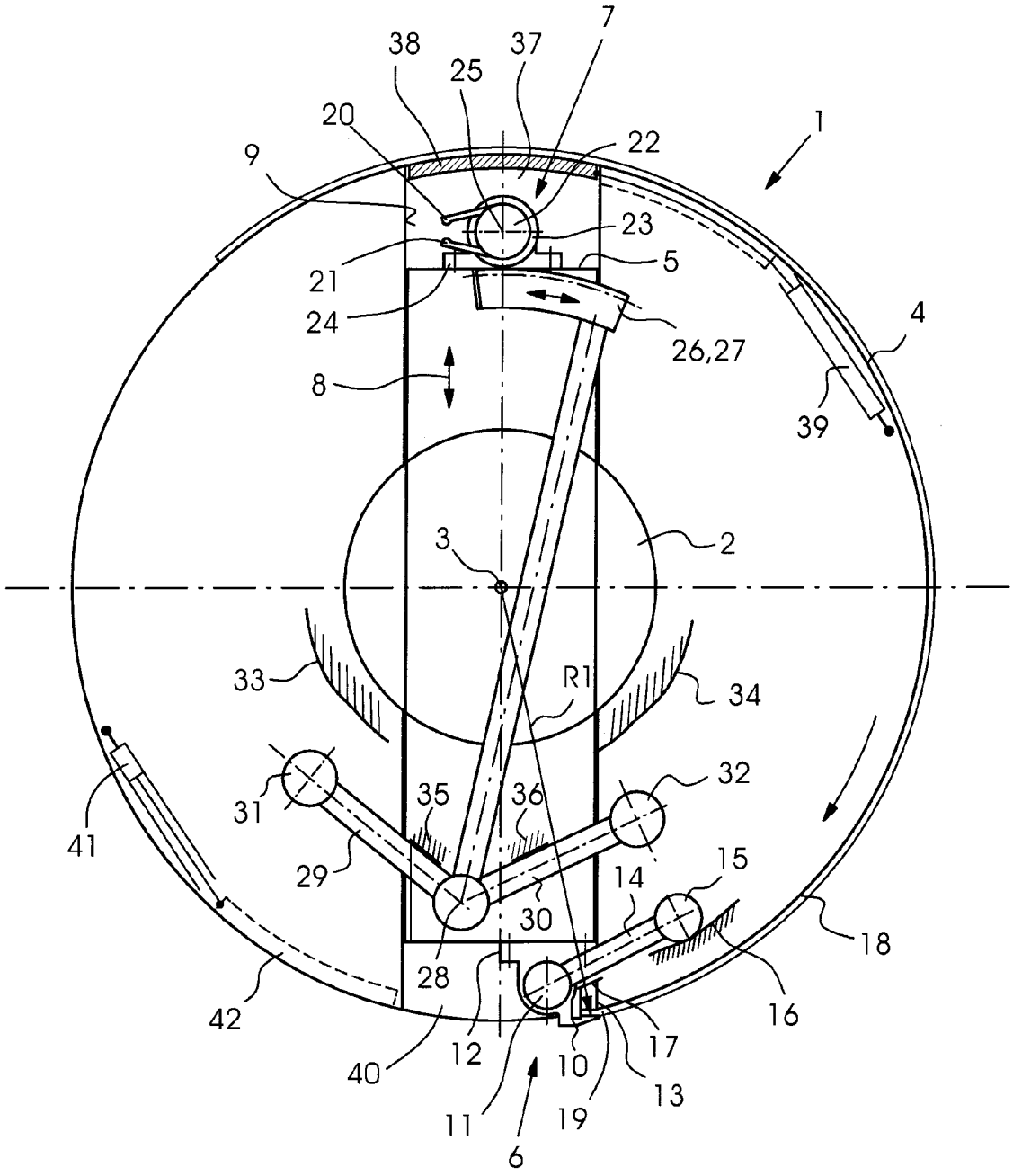
FIG. 1 is a side-elevational view of a reversing drum with a gripper system support in a first operating position.

Referring now to the figures of the drawings in detail and first, particularly, to FIG. 1 thereof, there is seen a transfer or reversing drum 1 of a reversing device in a sheet-fed printing press. Journals 2 support the reversing drum 1 for rotation about an axis 3 in side walls of the sheet-fed printing press. A support 5 for two gripper systems 6, 7 is disposed in a drum body 4 of the reversing drum 1 so as to be movable in the radial direction 8 in a linear guide 9.

The gripper system 6 is formed of a plurality of gripper fingers 10 attached to a gripper shaft 11. The gripper shaft 11 is supported for rotation in bearing blocks 12. The gripper shaft 11 is parallel to the axis 3. The bearing blocks 12 are screwed to the support 5. A gripper pad 13 that is firmly connected to the support 5 is associated with each gripper finger. The gripper fingers 10 are actuated by a cam mechanism, which includes a roller lever 14 connected to the gripper shaft 11, a cam follower 15, a control cam 16 and a stop 17 for the roller lever 14. The support 5 is located in a first radial position, which defines an operating position of the gripper system 6. In this operating position, the gripper pads 13 are located on a radius R1. Thus, to print on only one side of sheets 18, the gripper system 6 can take over a leading edge 19 of the sheets 18 from an upstream storage drum and transfer it to a downstream impression cylinder.

The gripper system 7 is formed of a plurality of first and second gripper fingers 20, 21, which cooperate in pairs. The gripper fingers 20, 21 are attached to a gripper shaft 22 and a gripper tube 23. The gripper shaft 22 and the gripper tube 23 are disposed to be coaxial with respect to each other and are supported for rotation in bearing blocks 24 parallel to the axis 3. The bearing blocks 24 are screwed to the support 5 in such a way that the gripper systems 6, 7 oppose each other on the support 5. With the aid of cam mechanisms, the gripper fingers 20, 21 carry out opening and closing movements and a pivoting movement about a joint axis 25 of the gripper shaft 22 and the gripper tube 23. For this purpose, gears meshing with toothed segments 26, 27 are attached to the gripper shaft 22 and the gripper tube 23. The toothed segments 26, 27 are supported on the support 5 to pivot about an axis 28. Roller levers 29, 30 are connected to the toothed segments 26, 27. The roller levers 29, 30 support cam followers 31, 32 associated with control cams 33, 34. The control cam 33 is used for opening and closing the gripper fingers 20, 21. The control cam 34 causes the gripper fingers 20, 21 to pivot about the axis 25. When the gripper system 6 has been moved to the operating position, the cam followers 31, 32 are disengaged from the cams 33, 34, and the roller levers 29, 30 rest against stops 35, 36 on the support 5. In the operating position of the gripper system 6, an opening 37 above the gripper system 7 is covered by a cover 38, which may be slid over the opening 37 through the use of an actuating cylinder 39.

Figure 2:
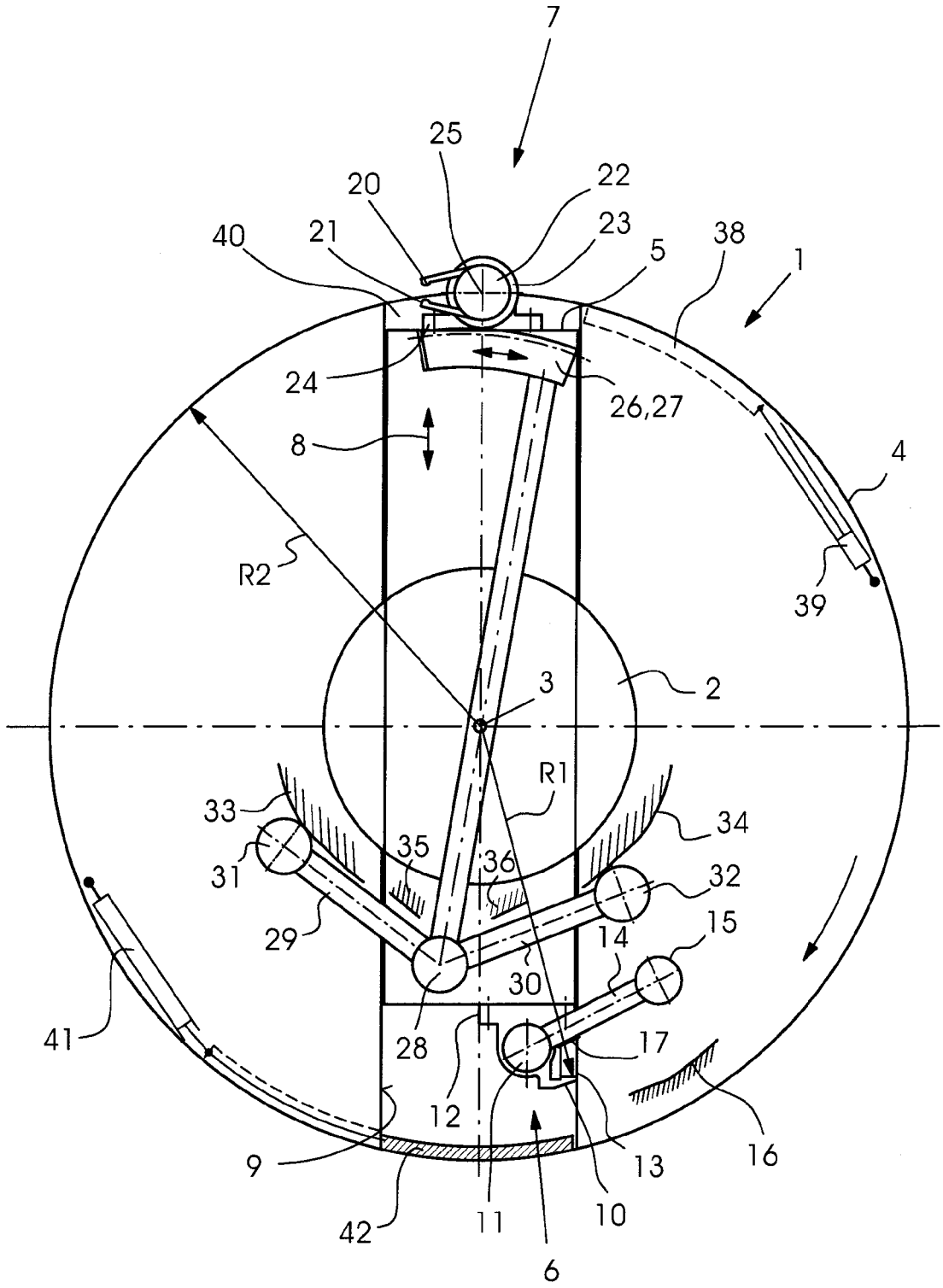
FIG. 2 is a side-elevational view of a reversing drum with a gripper system support in a second operating position.

FIG. 2 illustrates the support 5 in the second operating position in which the gripper system 6 is retracted and the gripper system 7 is extended in the radial direction. The gripper system 7 revolves on a radius R2. Consequently, to print on the respective second side of a respective sheet 18, the trailing edge of a sheet 18 can be taken over from an upstream storage drum and transferred to a downstream impression cylinder. In the second operating position, the cover 38 is slid back to clear the opening 37. A further actuating cylinder 41 has moved a cover 42 to close an opening 40 over the gripper system 6. In the second operating position, the cam rollers 31, 32 are engaged with the cams 33, 34, the levers 29, 30 are disengaged from the stops 35, 36, the cam follower 15 is disengaged from the cam 16, and the lever 14 rests against the stop 17.

Figure 3:
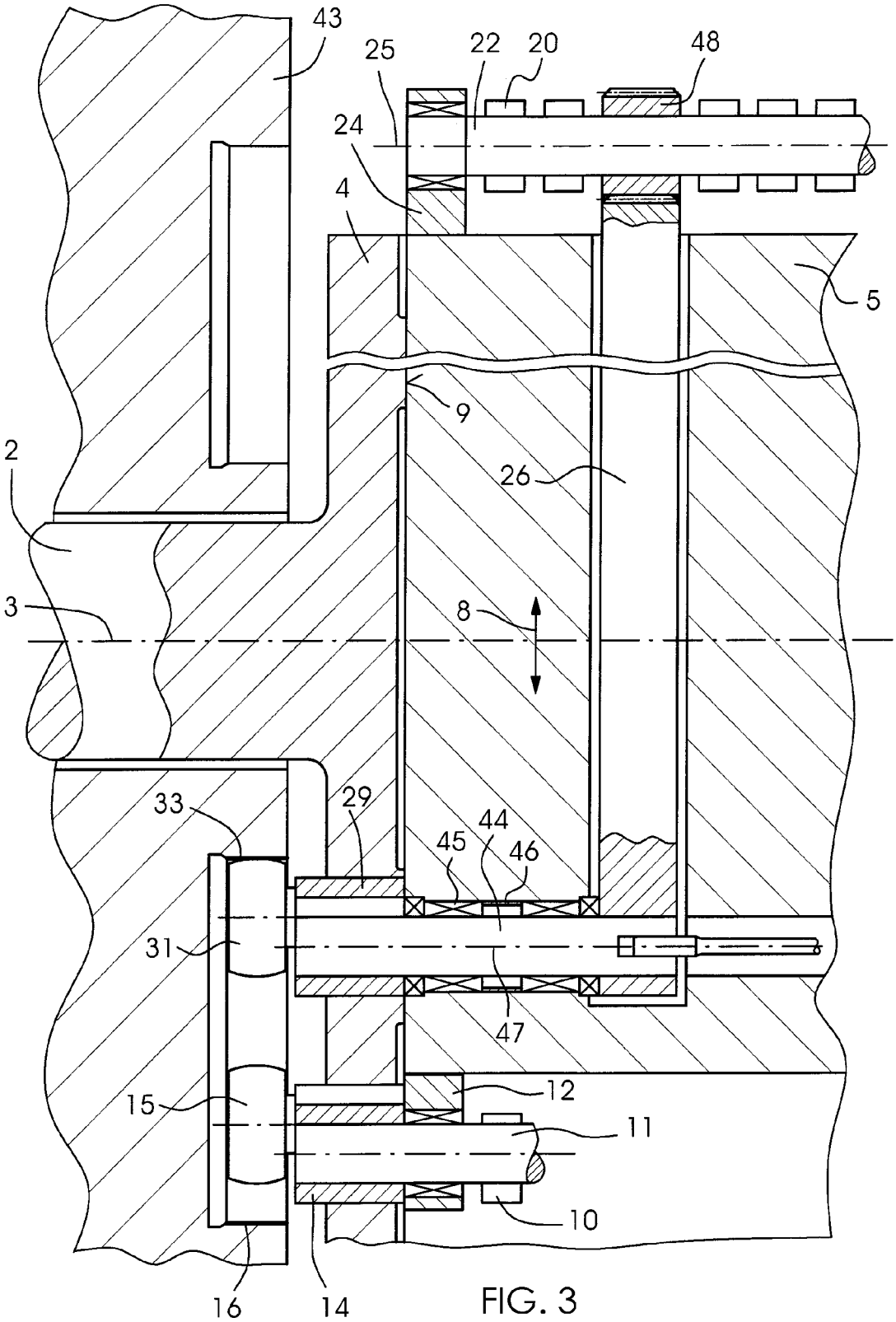
FIG. 3 is a sectional view along an axis of rotation of a reversing drum having two gripper systems.

FIG. 3 is a sectional view of the reversing drum 1, taken along the axis 3. The journal 2 is formed on the drum body 4 for supporting the drum body 4 in a side wall 43 of the sheet-fed printing press. In the direction of the axis 3, the support 5 extends across the entire width of the sheet 18. The support 5 is in the operating position shown in FIG. 2 for printing on both sides of the sheet 18. The roller lever 29 is fixed against rotation on a shaft 44, which is supported for rotation in bearings 45 in a bore 46 of the support 5. An axis of rotation 47 of the shaft 44 is parallel to the axis 3. The toothed segment 26 is fixed to the shaft 44. The toothed segment 26 meshes with a gear 48, which is fixed against rotation on the gripper shaft 22. The control cams 16, 33 are formed on the side wall 43. The cam follower 31 runs on the cam 33, whereas the cam follower 15 is disengaged from the cam 16 during printing on both sides of the sheets 18.

Figure 4:
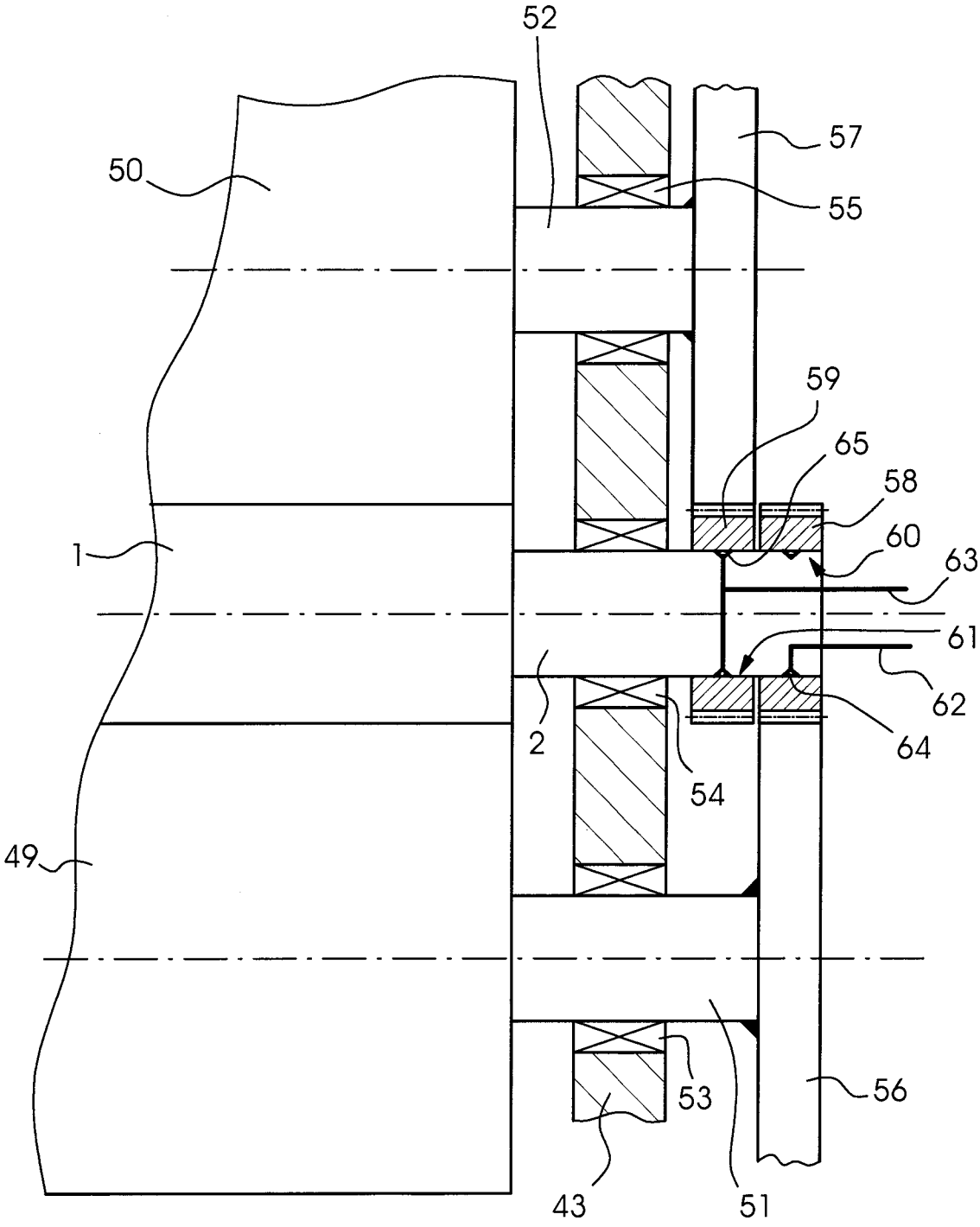
FIG. 4 is a partly-sectional view of a drive for drums in a reversing device.

FIG. 4 is a diagram of a drive of a storage drum 49, of the reversing drum 1 and of an impression cylinder 50. The storage drum 49, the reversing drum 1 and the impression cylinder 50 have respective journals 51, 2, 52 and bearings 53, 54, 55 for supporting them in the side wall 43. Gears 56, 57 are fixed against rotation on the journals 51, 52. Two gears 58, 59 are disposed on the journal 2. The two gears 58, 59 are connectable to the journal 2 so that they rotate therewith, and are disconnectable from the journal 2, through the use of a clutch 60, 61 operated by a pressure fluid. In a coupled state of the clutch 60, 61, the gears 58, 59 and the journal 2 form an interference fit assembly. In an uncoupled state, oil in lines 62, 63 and in grooves 64, 65 formed in the surface of the journal 2 is pressurized to release the interference fit, i.e. to cause the gears 58, 59 to be freely rotatable on the journal 2. In the uncoupled state, the angular positions of the storage drum 49 and of all other drums and cylinders connected thereto, and of the impression cylinder 50 and of all drums and cylinders connected thereto, can be adjusted relative to the reversing drum 1. Thus, during printing on only one side of the sheets 18, the gripper system 6 cooperates with the gripper systems of the storage drum 49 and of the impression cylinder 50, and during printing on both sides of the sheets 18, the grippers of the gripper system 7 have the desired angular position relative to the gripper systems of the storage drum 49 and the impression cylinder 5.

Figure 5:
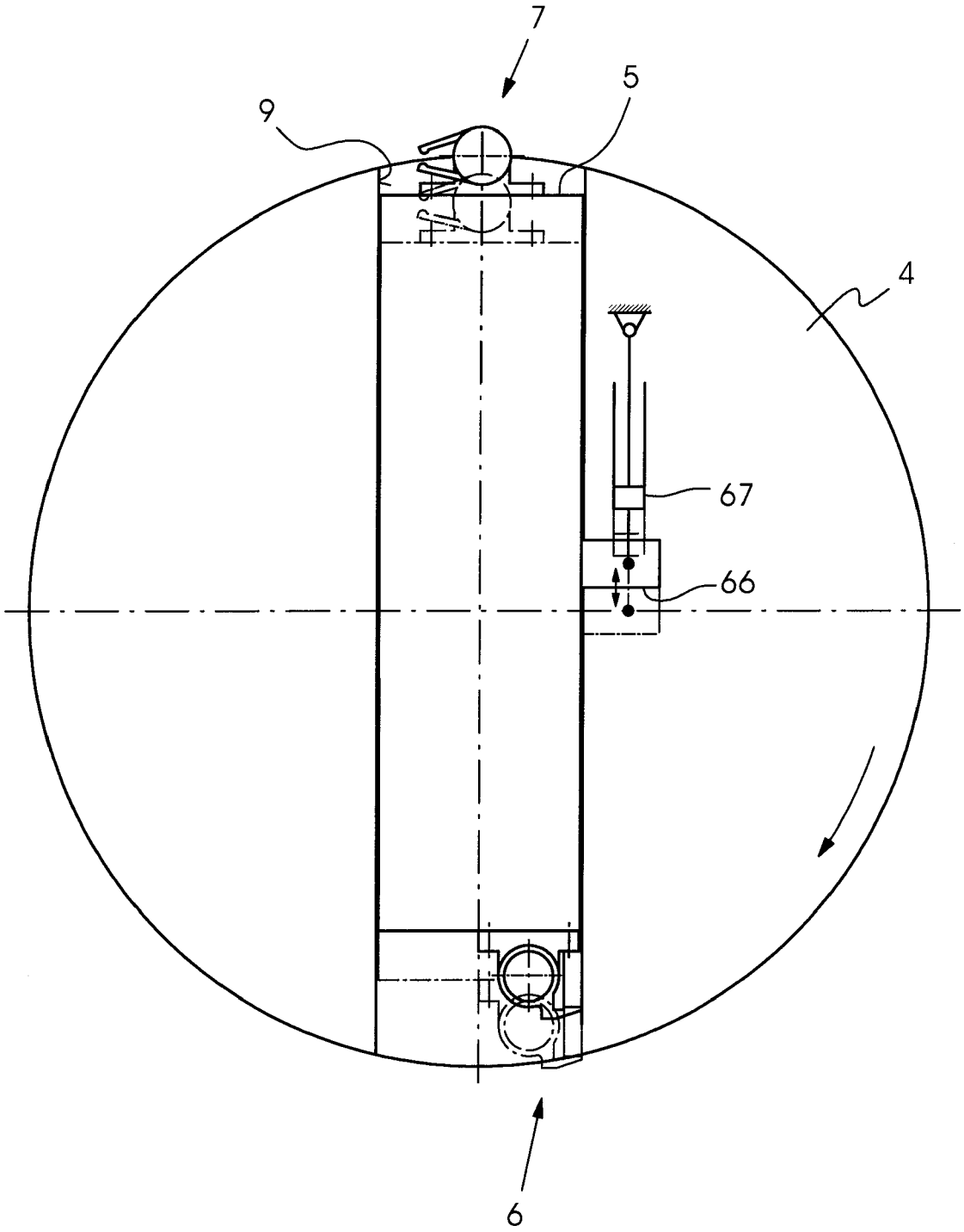
FIG. 5 is a side-elevational view of an actuating cylinder for a support of two gripper systems.

FIG. 5 illustrates one way of moving the support 5 and the gripper systems 6, 7 into the respective operating position. A coupling link 66 is provided on the support 5. The coupling link 51 is connected to an actuating cylinder 67 attached to the drum body 4. When the actuating cylinder 67 is actuated, the support 5 can be displaced in the linear guide 9 into the operating position, which is illustrated in dashed lines.

Figure 6:
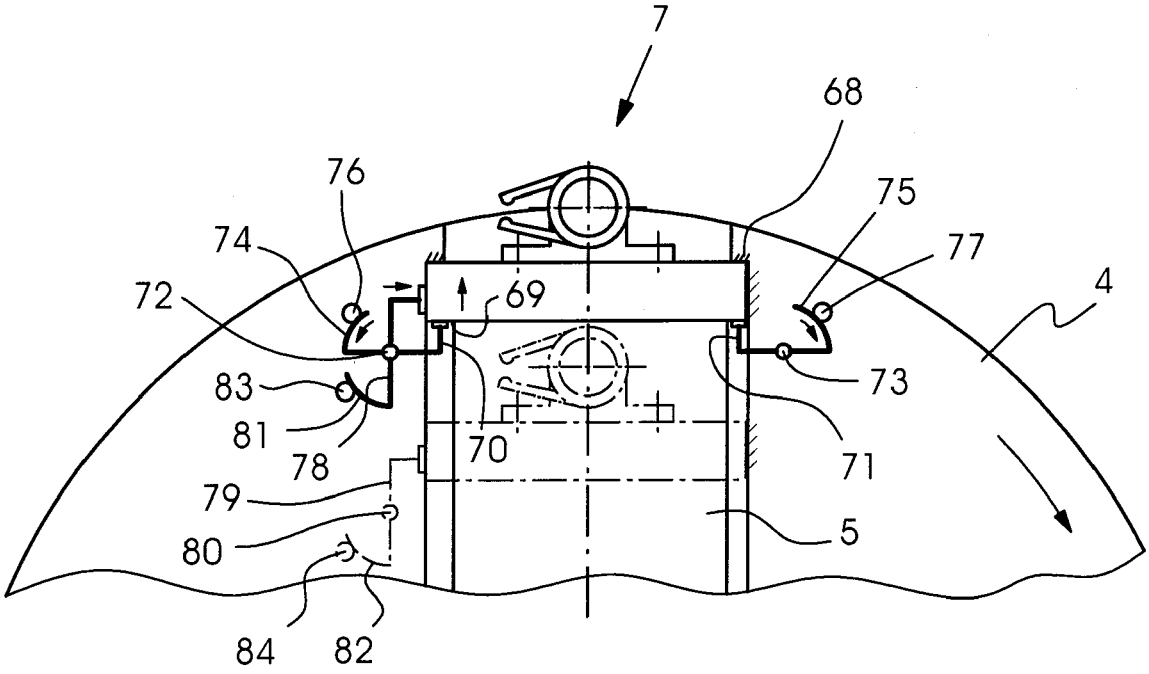
FIG. 6 is a fragmentary, side-elevational view of a clamping device for a support of two gripper systems.

FIG. 6 shows a clamping device for the support 5 in an operating position. The actuating cylinder 67 has moved the support 5 against a stop 68. The support 5 has a shoulder 69 on which ends of ratchet levers 70, 71 are placed. The levers 70, 71 are supported on the drum body 4 for rotation about bolts 72, 73. Toothed segments 74, 75 meshing with gears 76, 77 are fixed to the respective other ends of the levers 70, 71. A torque exerting a force on the lever 70, 71 through the toothed segment 74, 75 is applied to the gears 76, 77. The levers 70, 71 secure the support 5 in the radial direction. In order to secure the tangential position of the support 5, clamping levers 78, 79 are provided and are supported for rotation on the drum body 4 through the use of bolts 72, 80. Toothed segments 81, 82 meshing with gears 83, 84 are provided on one end of the levers 70, 71. Torques are applied to the gears 83, 84 in order to clamp the support in the tangential direction. A force acts through the toothed segments 81, 82 on the levers 78, 79 so that the respective other end of the lever presses the support 5 in the tangential direction against the guide path of the linear guide 9. The lever 78 is used to clamp the support 5 in the illustrated operating position. The lever 79 is used when the support 5 is moved in the illustrated second operating position.

An identical locking or clamping device of the support 5 is provided on the side having the gripper system 6.

The invention claimed is:

1. A transfer drum to be disposed between printing units of a sheet-fed printing press, the transfer drum comprising:

a drum body having an axis of rotation, having a linear guide and having journals for supporting said drum body for rotation in side walls;

two gripper systems disposed on said drum body for extension in radial direction into operating position positions, depending on a selection of a mode of operation for printing on only one side of a sheet or of a mode of operation for printing on both sides of a sheet;

one of said gripper systems being radially extended during printing on only one side of the sheet and including one gripper shaft parallel to said axis of rotation, a plurality of gripper fingers disposed to pivot on said one gripper shaft, and gripper pads associated with said gripper fingers;

the other of said gripper systems being radially extended during printing on both sides of the sheet and including another gripper shaft parallel to said axis of rotation, and a plurality of pliers-type grippers each being formed of two gripper fingers disposed to pivot on said other gripper shaft;

stops provided on said drum body and defining said respective operating positions of said gripper systems;

cam mechanisms including stationary control cams and cam followers on roller levers to control rotation of said gripper shafts; and a support disposed in said drum body for radial adjustment in said linear guide to support said gripper systems diametrically relative to said axis of rotation of said drum body, said support being movable against said stops and said support being lockable in a respective operating position on said drum body.

2. The transfer drum according to claim 1, wherein:

said gripper shaft of one of said gripper systems is moved by said support into said operating position and coupled to said cam mechanism associated therewith; and said gripper shaft of the other of said gripper systems is moved by said support out of said operating position and uncoupled from said cam mechanism associated therewith.

3. The transfer drum according to claim 1, which further comprises an actuating cylinder for moving said support.

* * * * *